US010503197B2

(12) United States Patent
Sugiura et al.

(10) Patent No.: US 10,503,197 B2
(45) Date of Patent: Dec. 10, 2019

(54) CURRENT GENERATION CIRCUIT

(71) Applicant: ABLIC Inc., Chiba-shi, Chiba (JP)

(72) Inventors: Masakazu Sugiura, Chiba (JP); Atsushi Igarashi, Chiba (JP); Nao Otsuka, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/220,762

(22) Filed: Dec. 14, 2018

(65) Prior Publication Data

US 2019/0187739 A1 Jun. 20, 2019

(30) Foreign Application Priority Data

Dec. 14, 2017 (JP) ..... 2017-239343

(51) Int. Cl.
*G05F 3/26* (2006.01)
*G05F 3/30* (2006.01)
*G05F 3/24* (2006.01)

(52) U.S. Cl.
CPC ..... *G05F 3/262* (2013.01); *G05F 3/24* (2013.01); *G05F 3/30* (2013.01)

(58) Field of Classification Search
None
See application file for complete search history.

(56) References Cited

U.S. PATENT DOCUMENTS 6,465,997 B2 * 10/2002 Kussener ..... G05F 3/30 323/313
6,831,505 B2 * 12/2004 Ozoe ..... G05F 3/262 323/313
7,557,558 B2 * 7/2009 Barrow ..... G05F 3/262 323/314
7,893,728 B2 * 2/2011 Hirai ..... G05F 3/24 327/103
2006/0001476 A1 1/2006 Yanagisawa et al.

FOREIGN PATENT DOCUMENTS

JP 2006-18663 1/2006

* cited by examiner

*Primary Examiner* — Jeffery S Zweizig
(74) *Attorney, Agent, or Firm* — Brinks Gilson & Lione

(57) ABSTRACT

A current generation circuit includes: a current source circuit including a first transistor and a first resistor, and configured to output a first current based on a source voltage or a drain voltage of the first transistor and a resistance of the first resistor; a current control circuit including a voltage input terminal, a second transistor and a third transistor, and configured to output a second current based on a source voltage of the second transistor and a resistance of the third transistor; and an impedance circuit including a second resistor formed of a same resistive body as the first resistor and a fourth transistor diode-connected to the second resistor, and configured to generate a control voltage at the voltage input terminal by the first current and the second current, wherein the current generation circuit is configured to output a current based on the second current.

4 Claims, 6 Drawing Sheets

CURRENT GENERATION CIRCUIT

RELATED APPLICATIONS

This application claims priority under 35 U.S.C. § 119 to Japanese Patent Application No. 2017-239343 filed on Dec. 14, 2017, the entire content of which is hereby incorporated by reference.

BACKGROUND OF THE INVENTION

1. Field of the Invention

The present invention relates to a current generation circuit.

2. Description of the Related Art

FIG. 6 shows a circuit diagram of a related art current generation circuit 600.

The related art current generation circuit 600 includes an error amplifier circuit 61, a voltage source 62, a resistor 63, an NMOS transistor 64, and PMOS transistors 65 and 66, and is constructed by connecting these components as illustrated in the drawing.

The error amplifier circuit 61 controls a gate voltage of the NMOS transistor 64 so that the voltage of the voltage source 62 and the voltage at node A generated by the current I flowing through the resistor 63 become equal. A current mirror circuit constituted from the PMOS transistors 65 and 66 generates a desired current Iout from the current I and outputs the same from an output terminal 67.

Since such a current generation circuit 600 as described above performs feedback-control of the current I flowing through the resistor 63, the current Iout can always be kept constant even if a change in operation temperature, variation in the threshold voltage of a transistor, etc., occur (refer to, for example, Japanese Patent Application Laid-Open No. 2006-18663).

SUMMARY OF THE INVENTION

In the above-described related art current generation circuit 600, however, since the current based on the resistance of the resistor 63 is generated, the current Iout is greatly affected by variation in resistance.

The present invention aims to provide a current generation circuit capable of generating a stable current in which the influence of variation in resistance is suppressed.

There is provided a current generation circuit according to an aspect of the present invention, including: a current source circuit including a first transistor having a gate to which a first bias voltage is supplied, and a first resistor connected to a source or drain of the first transistor, and configured to output a first current based on a source voltage or a drain voltage of the first transistor and a resistance of the first resistor; a current control circuit including a voltage input terminal, a second transistor having a gate to which a second bias voltage is supplied, and a third transistor connected to a source of the second transistor and having a gate to which a voltage of the voltage input terminal is supplied, the current control circuit being configured to output a second current based on a source voltage of the second transistor and a resistance value of the third transistor; and an impedance circuit including a second resistor formed of a same resistive body as the first resistor and a fourth transistor connected in series with the second resistor and having a gate and a drain being short-circuited, the impedance circuit being configured to generate a control voltage at the voltage input terminal by the first current and the second current, in which the current generation circuit outputs a current based on the second current.

A current generation circuit of the present invention includes a current source circuit, a current control circuit, and an impedance circuit. Since feedback of the control voltage, generated by the first current of the current source circuit and the second current of the current control circuit both flowing through the impedance circuit, to the current control circuit is performed, it is possible to generate a stable current in which influence of variation in resistance is suppressed.

DETAILED DESCRIPTION OF THE PREFERRED EMBODIMENTS

Embodiments of the present invention will hereinafter be described with reference to the accompanying drawings.

Figure 1:
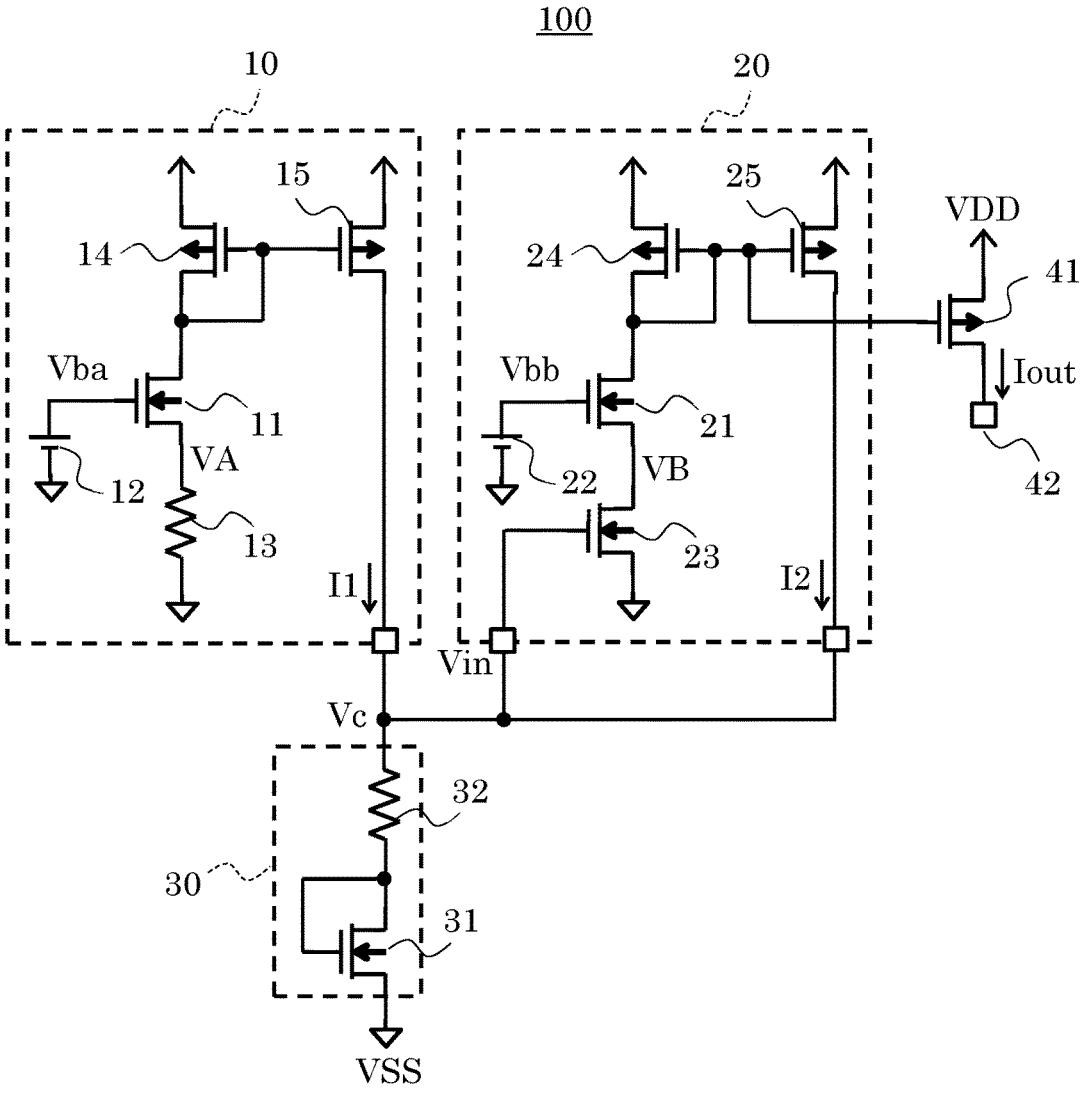
FIG. 1 is a circuit diagram illustrating a current generation circuit according to an embodiment of the present invention.

FIG. 1 is a circuit diagram of a current generation circuit 100 according to an embodiment of the present invention.

The current generation circuit 100 according to the embodiment includes a current source circuit 10, a current control circuit 20, an impedance circuit 30, an output transistor 41, and an output terminal 42.

The current source circuit 10 includes an NMOS transistor 11, a voltage source 12, a resistor 13, and PMOS transistors 14 and 15. The voltage source 12 supplies a bias voltage Vba to a gate of the NMOS transistor 11. The PMOS transistors 14 and 15 constitute a current mirror circuit.

When a source voltage of the NMOS transistor 11 is assumed to be VA, and the resistance value of the resistor 13 is assumed to be R1, the current source circuit 10 constructed as described above outputs a current I1 proportional to VA/R1.

The current control circuit 20 includes NMOS transistors 21 and 23, a voltage source 22, PMOS transistors 24 and 25, and a voltage input terminal Vin. The voltage source 22 supplies a bias voltage Vbb to a gate of the NMOS transistor 21. A voltage (called a control voltage Vc) of the voltage input terminal Vin is provided to a gate of the NMOS transistor 23 to control the on-resistance Ron thereof. The PMOS transistors 24 and 25 constitute a current mirror circuit.

When a source voltage of the NMOS transistor 21 is assumed to be VB, and the on-resistance of the NMOS transistor 23 is assumed to be Ron, the current control circuit 20 constructed as described above outputs a current I2 proportional to VB/Ron. Further, the on-resistance Ron of the NMOS transistor 23 is controlled by the voltage provided to the voltage input terminal Vin.

The impedance circuit 30 includes an NMOS transistor 31, and a resistor 32. The impedance circuit 30 converts an entering current into a voltage based on a resistance R2 of the resistor 32 and the impedance of the diode-connected NMOS transistor 31. Here, the resistor 32 is formed from the same resistive body (material) as the resistor 13 to have the same characteristic variation.

The operation of the current generation circuit 100 according to the embodiment will next be described.

The current source circuit 10 outputs a current I1 which is proportional to VA/R1, and is also affected by variation in the resistance of the resistor 13.

When the current I1 is provided, the impedance circuit 30 generates a voltage which doesn't depend on the variation in the resistance across the resistor 32 and generates a voltage affected by the variation in the resistance of the resistor 13 at the NMOS transistor 31. When the resistance of the resistors 13 and 32 are higher than the desired resistance, the control voltage Vc generated in the impedance circuit 30 thus becomes low since the current I1 becomes small.

The current control circuit 20 outputs a current I2 proportional to VB/Ron. Assuming that the voltage provided to the voltage input terminal Vin remains unchanged, the current I2 is unaffected by the variation in the resistance of the resistor 13.

When the current I2 is provided, the impedance circuit 30 generates a voltage affected by the variation in the resistance across the resistor 32 and generates a voltage which doesn't depend on the variations in the resistance at the NMOS transistor 31. When the resistance of the resistors 13 and 32 are higher than the desired resistance, the control voltage Vc generated in the impedance circuit 30 thus becomes high.

Here, since the control voltage Vc becomes low by the flow of the current I1 through the impedance circuit 30, i.e., by the relation between the resistor 13 and the NMOS transistor 31, and the control voltage Vc becomes high by the flow of the current I2 through the impedance circuit 30, i.e., by the relation between the NMOS transistor 23 and the resistor 32, these influences are canceled so that the current I2 becomes a stable constant current.

The current generation circuit 100 can thus supply a stable constant output current Tout from the output terminal 42 by providing, for example, the output transistor 41 connected in parallel with the transistor 25 constituting the current mirror circuit which supplies the current I2.

As described above, having provided the current source circuit 10, the current control circuit 20, and the impedance circuit 30, the current generation circuit 100 is capable of generating a stable current in which the influence of the variation in resistance is suppressed.

Incidentally, operation in the weak inversion region of the transistor 11 which outputs the voltage VA gives effect that the voltage VA becomes invulnerable to change because a gate-source voltage of the transistor 11 becomes invulnerable to change even if the current of the transistor 11 changes. Further, the same can be applied to the transistor 21 which outputs the voltage VB.

The above-described current source circuit 10, current control circuit 20 and impedance circuit 30 are illustrated by way of example. They can be modified and combined in various ways within the scope not departing from the spirit of the invention.

Figure 2:
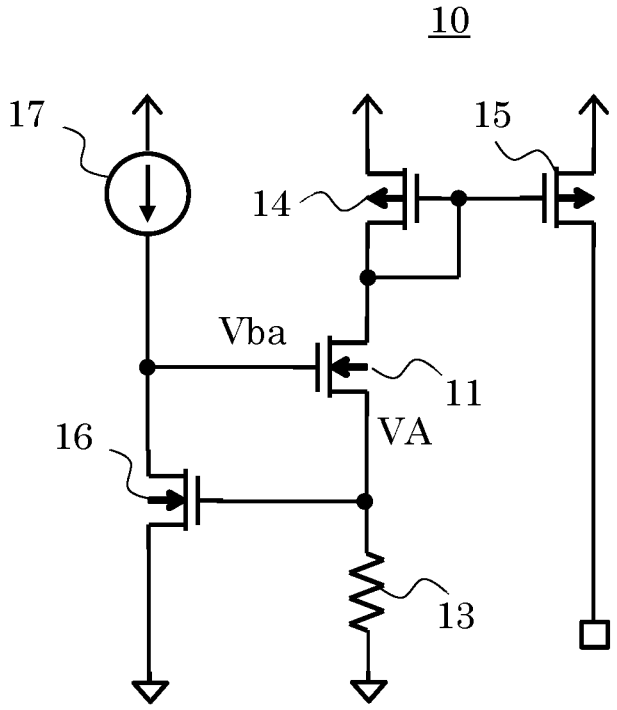
FIG. 2 is a circuit diagram illustrating another example of a current source circuit in the embodiment.

FIG. 2 is a circuit diagram illustrating another example of the current source circuit 10 in the embodiment. The current source circuit 10 illustrated in FIG. 2 is constituted from an NMOS transistor 16 whose gate is connected to a source of an NMOS transistor 11, and a constant current source 17 supplying a constant current to the NMOS transistor 16, instead of the voltage source 12 which supplies the bias voltage Vba to the gate of the NMOS transistor 11. In the current source circuit 10 constituted in this manner, the magnitude of the current I1 can be adjusted even at the threshold voltage of the NMOS transistor 16 because the voltage VA is determined by the gate-source voltage of the NMOS transistor 16.

Figure 3:
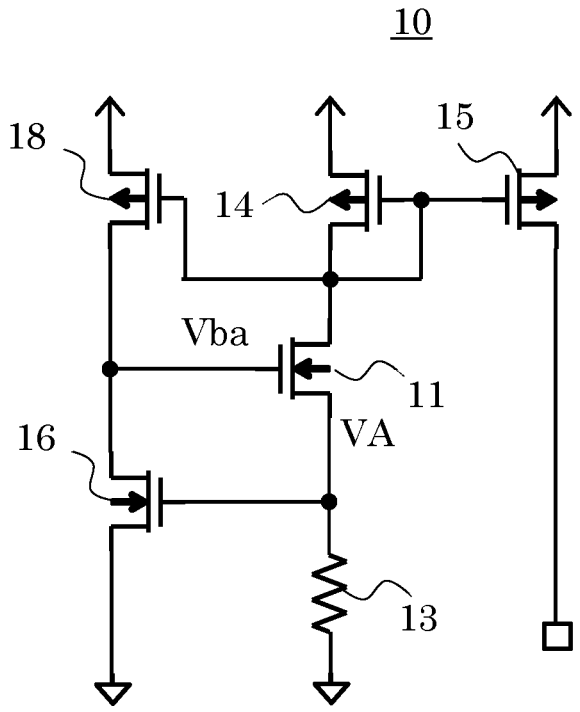
FIG. 3 is a circuit diagram illustrating a further example of the current source circuit in the embodiment.

Further, as shown in FIG. 3, the current source circuit 10 may be constituted from a PMOS transistor 18 which forms a current mirror circuit with a PMOS transistor 14 instead of the current source 17. Alternatively, the current source circuit 10 may be constituted from the current source 17 and the PMOS transistor 18.

Figure 4:
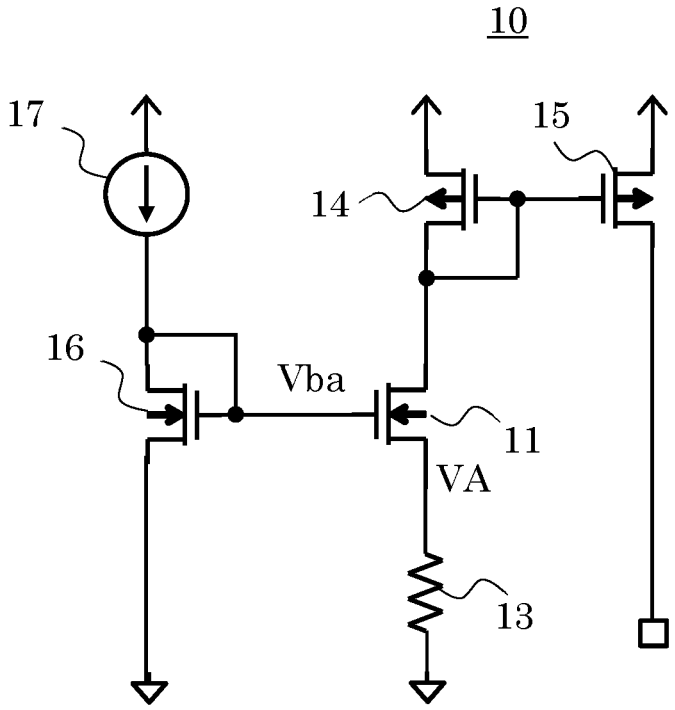
FIG. 4 is a circuit diagram illustrating a yet another example of the current source circuit in the embodiment.

FIG. 4 is a circuit diagram illustrating a yet another example of the current source circuit 10 in the embodiment. The current source circuit 10 of FIG. 4 is constituted from an NMOS transistor 16 whose gate and drain are connected, and a constant current source 17 supplying a constant current to the NMOS transistor 16 as an alternative to the voltage source 12. The current source circuit 10 constituted in this manner gives an effect that the voltage VA is not affected by variation in the threshold voltage of the NMOS transistor 11 since the voltage VA is determined based on the difference between the gate-source voltages of the NMOS transistor 11 and the NMOS transistor 16. Further, as illustrated in FIG. 3, the current source circuit 10 may have a PMOS transistor instead of the current source 17. Alternatively, the current source circuit 10 may have both.

Figure 5:
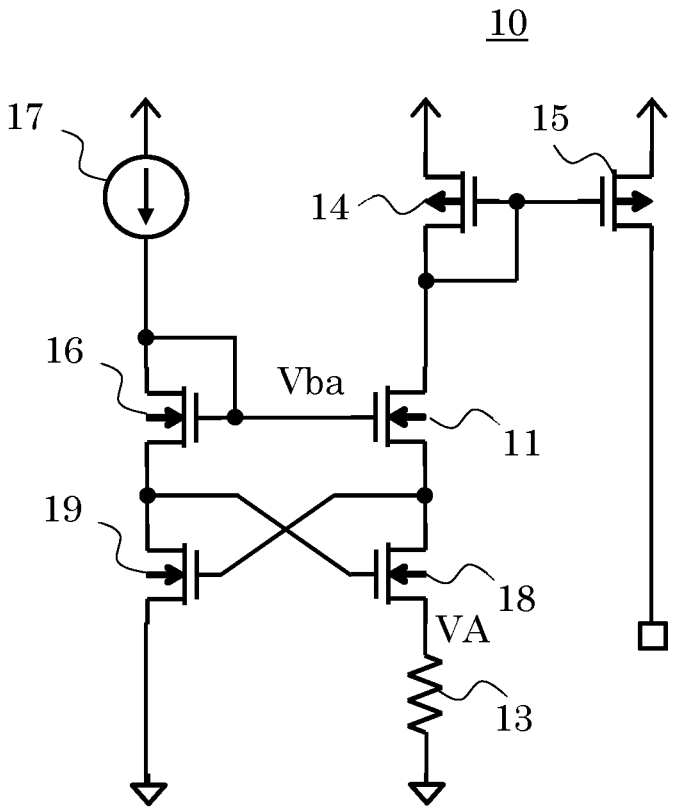
FIG. 5 is a circuit diagram illustrating a still further example of the current source circuit in the embodiment.

Also, as shown in FIG. 5, a current source circuit 10 may include NMOS transistors 18 and 19 whose gates and drains are respectively connected, and determine a voltage VA based on the differences between or the sum of gate-source voltages of the NMOS transistors 11, 16, 18 and 19. In the current source circuit 10 constituted in this manner, since the voltage VA can be made higher than that in the current source circuit 10 of FIG. 4, the magnitude of a current I1 can be thereby adjusted.

Further, although the circuit examples of the current source circuit 10 have been illustrated above through FIGS. 2 to 5, the current control circuit 20 can have a constitution similar to the above. Alternatively, the current source circuit and the current control circuit may be used in combination freely.

Figure 6:
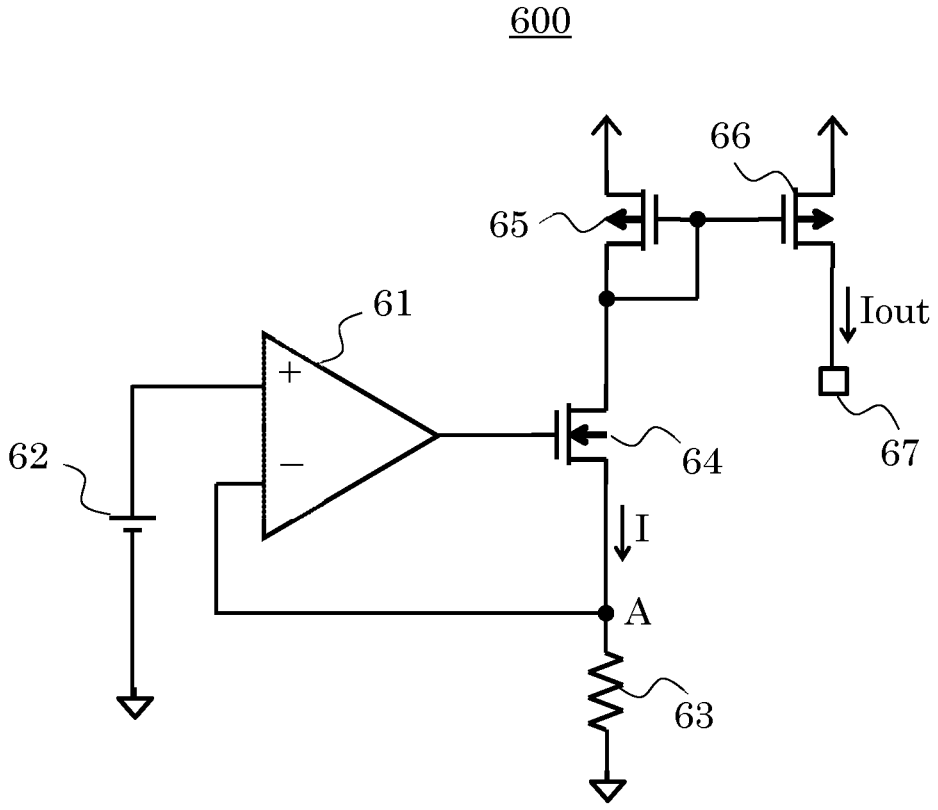
FIG. 6 PRIOR ART
FIG. 6 is a circuit diagram illustrating a related art current generation circuit.

Furthermore, in the current source circuit 10, a negative feedback circuit using the error amplifier circuit of FIG. 6 may be adopted as a circuit which obtains the voltage VA.

Besides, although the above embodiment has been described as the example in which the impedance circuit 30 has the diode-connected NMOS transistor 31, a PN junction element such as a diode may be used.

What is claimed is:

1. A current generation circuit comprising:

a current source circuit comprising a first transistor having a gate to which a first bias voltage is supplied, and a first resistor connected to a source or drain of the first transistor, and configured to output a first current based on a source voltage or a drain voltage of the first transistor and a resistance of the first resistor;

a current control circuit comprising a voltage input terminal, a second transistor having a gate to which a second bias voltage is supplied, and a third transistor connected to a source of the second transistor and having a gate to which a voltage of the voltage input terminal is supplied, the current control circuit being configured to output a second current based on a source voltage of the second transistor and a resistance of the third transistor; and an impedance circuit comprising a second resistor formed of a same resistive body as the first resistor, and a fourth transistor connected in series with the second resistor and having a gate and a drain being short-circuited, the impedance circuit being configured to generate a control voltage at the voltage input terminal by the first current and the second current, wherein the current generation circuit is configured to output a current based on the second current.

2. The current generation circuit according to claim 1, wherein the first bias voltage is a voltage at which the first transistor operates in a weak inversion region.

3. The current generation circuit according to claim 1, wherein the second bias voltage is a voltage at which the second transistor operates in a weak inversion region.

4. A current generation circuit comprising:

a current source circuit comprising a first transistor having a gate to which a first bias voltage is supplied, and a first resistor connected to a source or drain of the first transistor, and configured to output a first current based on a source voltage or a drain voltage of the first transistor and a resistance of the first resistor;

a current control circuit comprising a voltage input terminal, a second transistor having a gate to which a second bias voltage is supplied, and a third transistor connected to a source of the second transistor and having a gate to which a voltage of the voltage input terminal is supplied, the current control circuit being configured to output a second current based on a source voltage of the second transistor and a resistance of the third transistor; and an impedance circuit comprising a second resistor formed of a same resistive body as the first resistor, and a PN junction element connected in series with the second resistor, the impedance circuit being configured to generate a control voltage at the voltage input terminal by the first current and the second current, wherein the current generation circuit is configured to output a current based on the second current.

* * * * *